US005575678A

United States Patent [19]

Okumura et al.

[11] Patent Number: 5,575,678

[45] Date of Patent: Nov. 19, 1996

[54] LOCKING CONNECTOR

[75] Inventors: Hitoshi Okumura; Koichiro Tokuwa, both of Yokkaichi, Japan

[73] Assignee: Sumitomo Wiring Systems, Ltd., Japan

[21] Appl. No.: 364,135

[22] Filed: Dec. 27, 1994

[30] Foreign Application Priority Data

Dec. 27, 1993 [JP] Japan ..... 5-350076

[51] Int. Cl.[6] ..... H01R 13/639

[52] U.S. Cl. ..... 439/372; 439/489

[58] Field of Search ..... 439/379, 345, 439/347, 310, 188, 350, 352, 355, 357, 358, 489

[56] References Cited

U.S. PATENT DOCUMENTS 4,884,978 12/1989 Inaba et al. ..... 439/352
5,017,147 5/1991 Sugiyama et al. ..... 439/372
5,035,644 7/1991 Nakazato et al. ..... 439/372
5,201,670 4/1993 Watanabe et al. ..... 439/372
5,376,017 12/1994 Tamiuchi et al. ..... 439/489

*Primary Examiner*—Hien D. Vu
*Attorney, Agent, or Firm*—Jordan B. Bierman; Bierman and Muserlian

[57] ABSTRACT

A process of a contact member moving over peaked slanting surfaces. A female connector housing is urged into its proper coupling position if a movable member is pressed in after the female connector housing has been inserted to a predetermined position. Conversely, if the movable member is pressed in when the female connector housing has not yet reached its predetermined position, the female connector housing is pressed out. This eliminates the possibility of partial coupling of the female and male connector housings, as the coupling failure is easily noticeable. It also enables the coupling of the connector with a small force due to the leverage obtained.

8 Claims, 5 Drawing Sheets

LOCKING CONNECTOR

This Application claims the benefit of the priority of Japanese Application 350076/93, filed Dec. 27, 1993.

The present Invention relates to a connector provided with a mechanism for assisting the coupling of the male and female members.

BACKGROUND OF THE INVENTION

In prior art, it is known to use lever type connectors when male and female elements having 20 or more contacts are to be connected and where a large coupling force is required. By doing so, male and female connectors can easily be coupled with a relatively small force as a result of the leverage obtained.

The conventional lever type connectors include a (1) a male connector housing formed with a hood so that a female connector housing can be inserted, (2) a notch which extends in the direction of insertion and withdrawal of the female connector housing, so as to permit the insertion of a guide pin projecting outward from a side surface of the female connector housing, and (3) a lever which is rotatably supported and has a slanting surface opposite the notch. The slanting surface is formed so that it is not on the notch when the lever is in its initial position, but moves toward the back of the notch as the lever is rotated.

In this construction, as the female connector housing is inserted into the hood of the male connector housing, the guide pin is guided to the vicinity of the entrance of the notch. However, terminal fittings carried by the male and female connectors come into contact, thereby hindering the insertion of the guide pin into the notch. When the end of the lever is held and rotated in this state, the slanting surface of the lever moves toward the back of the notch and the guide pin is pressed into the back of the notch thereby. The male and female connectors can easily be coupled with a small force because the distance the guide pin is pressed into the notch is short and the rotating range of the lever is large.

With the conventional connectors as mentioned above, the lever is rotated after the female connector housing is inserted until the slanting surface engages with the guide pin; the female connector housing is then pressed into the male connector housing. However, despite the fact that the lever is rotated fully, the female connector housing may not yet be completely inserted to the specified position. Thus, the male and female connectors are accurately coupled, resulting in a bad or insufficient electrical connection or even no electrical connection at all. In a worse case, it may not be noticed that these connectors are only partially coupled.

There are applications, e.g., in motor vehicles or medical apparatus, where perfect electrical connections are absolutely indispensable, e.g., for security reasons. For these applications, the known connectors are not suitable since, if the mating connectors are inserted into each other, there is no certainty that a proper electrical connection has been achieved. In view of the above problem, it is an object of the Invention to provide a connector which can be coupled with a small force and is free from coupling failure such as partial coupling.

SUMMARY OF THE INVENTION

In order to accomplish the above object, the Invention is directed to a connector comprising first and second connector housings having mating terminal fittings, a projection provided on the first connector housing, and a contact member provided on the second connector housing and substantially opposite to the projection, the projection and the contact member interacting upon contact in such a way that they urge the first and second connector housings to move relatively to each other.

By pairing the projection, preferably having peaked slanting surfaces, and the contact member, the second connector housing is pulled completely to its proper coupling position or pushed out when the projection, preferably on a movable member, is pressed in. This makes the coupling failure easily visible, thereby eliminating the possibility of overlooking it.

DETAILED DESCRIPTION OF THE INVENTION

In a preferred embodiment of the inventive connector, unless a large force is applied, the second connector housing cannot be properly inserted into the accommodation space of the first connector housing because of contact between the terminal fittings. The first connector housing is preferably provided with a movable member which is movable toward and away from a predetermined position of the first connector housing. The projection, having preferably peaked slanting surfaces, is formed on one of the housings, and the contact member, which preferably comes into sliding contact with the peaked slanting surface, is formed on the other. It is preferable that the projection be on the movable member. The contact member is preferably arranged to come into sliding contact with the peaked slanting surfaces of the projection when the second connector housing is inserted and withdrawn. During the insertion of the second connector housing, the movable member preferably moves away from the first connector when the contact member is in sliding contact with the upward slanting surface, while moving toward the first connector during coupling of the first and second connector housings, when the contact member moves over the peak of the slanting surfaces and starts sliding along the downward slanting surface.

In a preferred embodiment of the Invention, the second connector housing is inserted into the first connector housing until the contact member touches the projection. In this embodiment, the projection is provided with an upward slanting surface and a downward slanting surface, which surfaces meet at a peak. Similarly, it is preferred that the contact member have a front slanting face and a rear slanting face. It is most advantageous that, when the housings are in the foregoing partially inserted position, the contact member press against the downward slanting surface of the projection. It is still more preferable if the rear slanting face of the contact member bears against the downward slanting surface. By doing so, the second connector housing is pulled firmly and completely into the first connector housing when the projection is urged toward the contact member.

Alternatively, if the second connector housing is not sufficiently inserted into the first connector housing when the movable member (carrying the projection) is pressed toward the accommodation space, the upward slanting surface of the projection bears against the contact member, preferably against the front slanting face thereof. In this manner, when the movable member is closed, the second connector housing is pushed substantially out of the accommodation space.

When the projection is pushed in, the second connector housing is either pulled in or pushed out of the first connector housing and does not end up at an intermediate coupling position. The position of the projection when the second connector housing is pulled in to the proper coupling position is fixed, and the distance which the projection is pushed in is determined accordingly. The coupled state of the connector housings can be visibly judged by the push-in distance of the projection. For instance, when the push-in distance is set such that the projection is completely pushed in at the proper coupling position, if the coupling is improper, the projection will easily be seen to be raised, even if only slightly.

Preferably, the projection is on the movable member and is formed in such a way as to project into the accommodation space of the first connector housing. The contact member is on the second connector housing, extending toward the projection. If the projection is on the second connector housing, it is accommodated in the accommodation space of the first connector housing; the contact member is formed at the first connector housing, preferably on the movable member, to face the accommodation space.

In another embodiment of the Invention, the movable member is rotatably supported on the first connector housing. Accordingly, the movable member is moved toward or away from the first connector housing by being rotated about the point of support, and the leverage therefrom resulting in a mechanical advantage is obtained.

In a preferred embodiment of the inventive connector, the movable member is formed into a hood which extends along the surfaces of the first connector housing and is in close contact with the first connector housing when completely pressed toward the accommodation space.

It has been found advantageous to provide that the movable member is constantly biased toward the side surface of the first connector housing. The contact member is thereby urged against the projection, preferably the peaked slanting surfaces thereof, during the coupling of the first and second connector housings. The distance of the projection from the first connector housing indicates with which part of the projection the contact member is in contact.

According to this embodiment of the Invention, since the projection is biased toward one side surface of the first connector housing, the contact member is constantly pressed against the projection, preferably against its peaked, slanting surfaces. The secure coupled state of the second connector housing can be seen based on the positional relationship between the movable member and the first connector housing.

In another preferred embodiment of the inventive connector, the biasing means or spring portion is formed at the end of the movable member opposite its moving end with the point of support between the two ends. The more the movable member is rotated about the point of support, the more the biasing means is pressed against the first connector housing, thereby acting to rotate the movable member in the opposite direction. As a result, the movable member is biased toward the first connector housing.

Preferably, the peaked slanting surfaces may be upward and downward slanting surfaces formed on the surface of one member; or they may be formed by separate members each having only an upward slanting surface or a downward slanting surface. Contact members corresponding to these separate members are formed such that one contact member starts sliding along the downward slanting surface after the other contact member reaches the peak of the upward slanting surface. The projection having the peaked slanting surfaces may be formed as a separate member, or may be formed by making a recess and a projection on the wall surface.

BRIEF DESCRIPTION OF THE DRAWINGS

In the accompanying drawings, constituting a part hereof, and in which like reference characters indicate like part.

In FIGS. 1 to 3, a female connector housing 10 is formed internally with two tubular terminal chambers 12, 12' which can accommodate female fittings 11 therein and extend in the longitudinal direction of the housing 10. The two chambers 12, 12' are formed side by side in the lateral direction of the housing 10. As shown in FIG. 2, an engaging portion or lance 13 is formed at the inner bottom wall of each chamber 12, 12' so that the inserted female terminal fitting 11 can be locked therein. A communication hole **12*a* in communication with the outside is formed in the upper wall of each chamber 12, 12'. When a retainer 14 engages the upper surface of the female connector housing 10 and moves within its movable range, locking portions 14*a* of the retainer 14 enter the chambers 12, 12' through the communication hole 12*a*. In this way, the fittings 11 which are already locked in the chambers 12, 12'** can be doubly locked.

Figure 1:
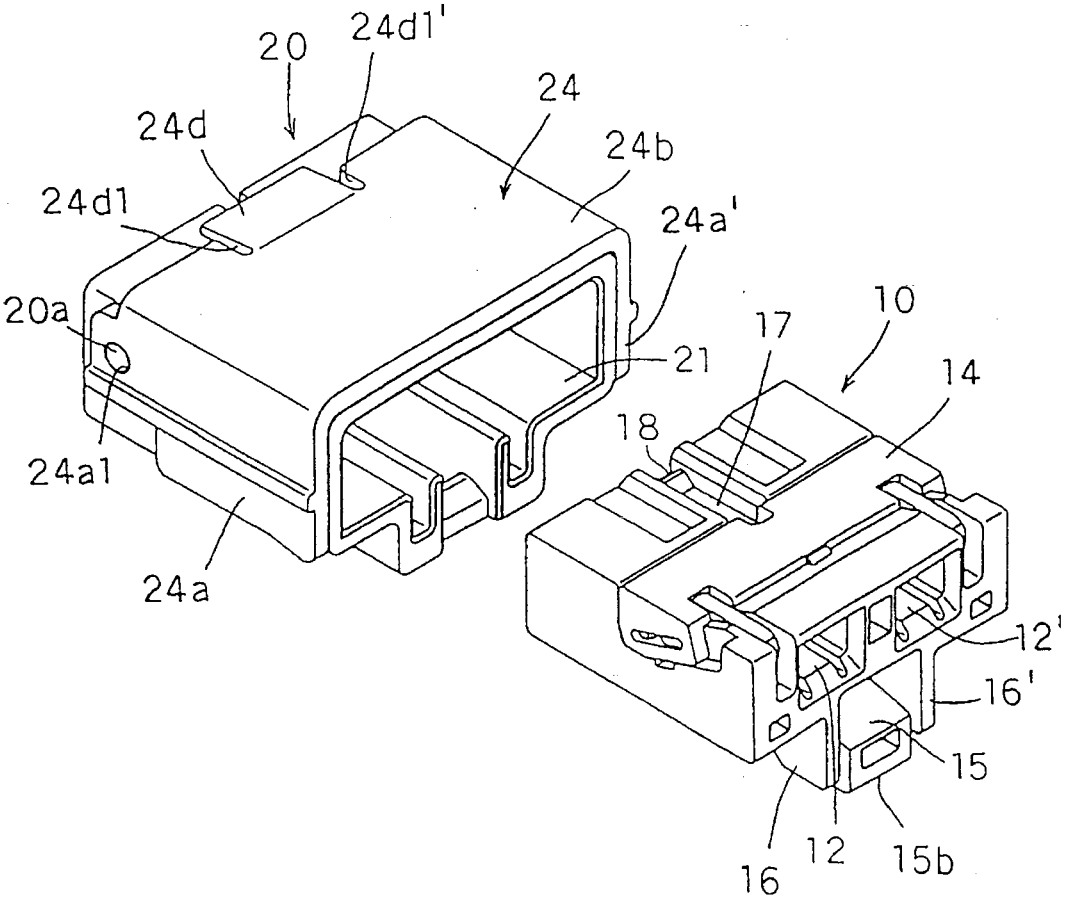
FIG. 1 is a perspective view of one embodiment of the Invention, viewed obliquely from above.

A lock arm 15 is formed at the lower surface of the housing 10. The lock arm 15 is continuous or integral with the front end of the lower surface of the housing 10 and extends toward its rear end, that is the end of the housing opposed to the end inserted first into a male housing 20, as described below. At the lateral opposite sides of the lock arm 15, there are formed plate-like guide walls 16, 16' which project downward along the lock arm 15. The lock arm 15 carries a locking projection **15*a*, which projects downward at an intermediate position thereof, and an operable portion 15*b*, which projects downward at the rear end thereof. The operable portion 15*b*** is preferably a tubular member.

A space is formed between the laterally arranged chambers 12 and 12'. A slit 17 which communicates with this space is formed substantially in the middle of the upper wall of the female connector housing 10 with respect to its lateral direction. The slit 17 extends backward substantially from the front end of the housing 10. A beam-like contact member 18 is formed to connect the side walls of the slit 17 at its front end. The upper surface of the contact member 18 is peaked and includes a front slanting surface **18*a* and a rear slanting surface 18*b***.

The male connector housing 20 is a tubular body having a substantially closed bottom such that the female connector housing 10 can be inserted through an opening 21 and accommodated therein. Two male terminal fittings 22 arranged side by side are held at the rear wall of the housing 20 at positions opposed to the mating female terminal fittings 11 accommodated in the chambers 12, 12' of the female connector housing 10. A movable member 24 in the form of a hood having a substantially U-shaped cross-section is mounted on connector 20 to cover the side surfaces and upper surface thereof. Through holes 24*a*l and 24*a*1' are formed in the side walls 24*a* and 24*a*' of the movable member 24. Pins 20*a* and 20*a*' project outward in the lateral direction from the opposite side surfaces of the housing 20 at the upper position of its rear end, i.e. a longitudinal end opposite from the end where the opening 21 is defined. The pins 20*a*, 20*a*' are inserted into the holes 24*a*1, 24*a*1' thereby rotatably mounting the movable member 24 on the male connector housing 20.

Figure 2:
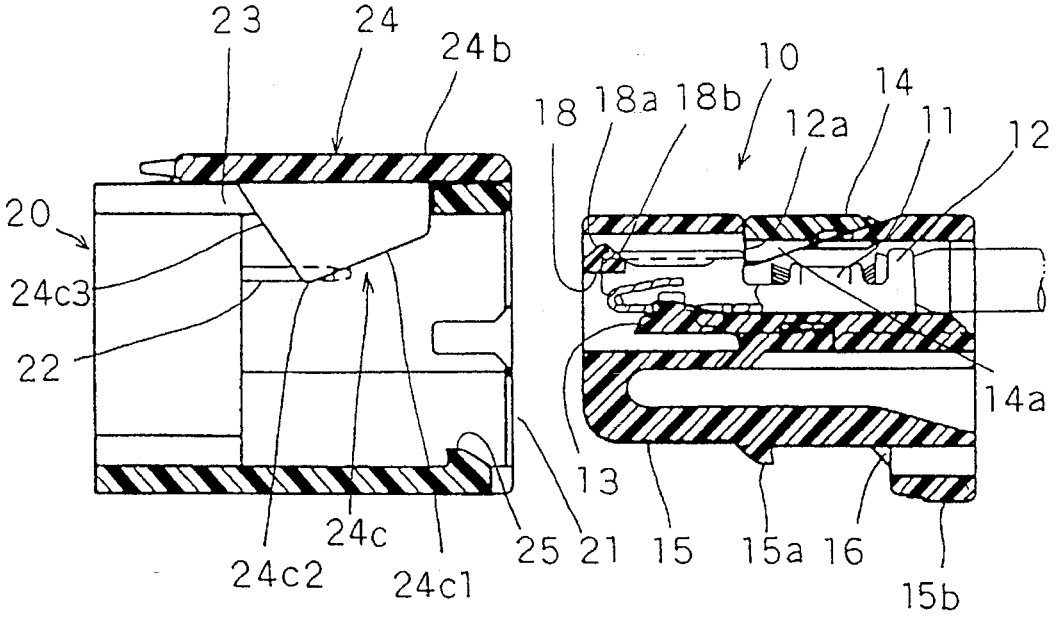
FIG. 2 is a sectional view of the connector of FIG. 1.
Figure 3:
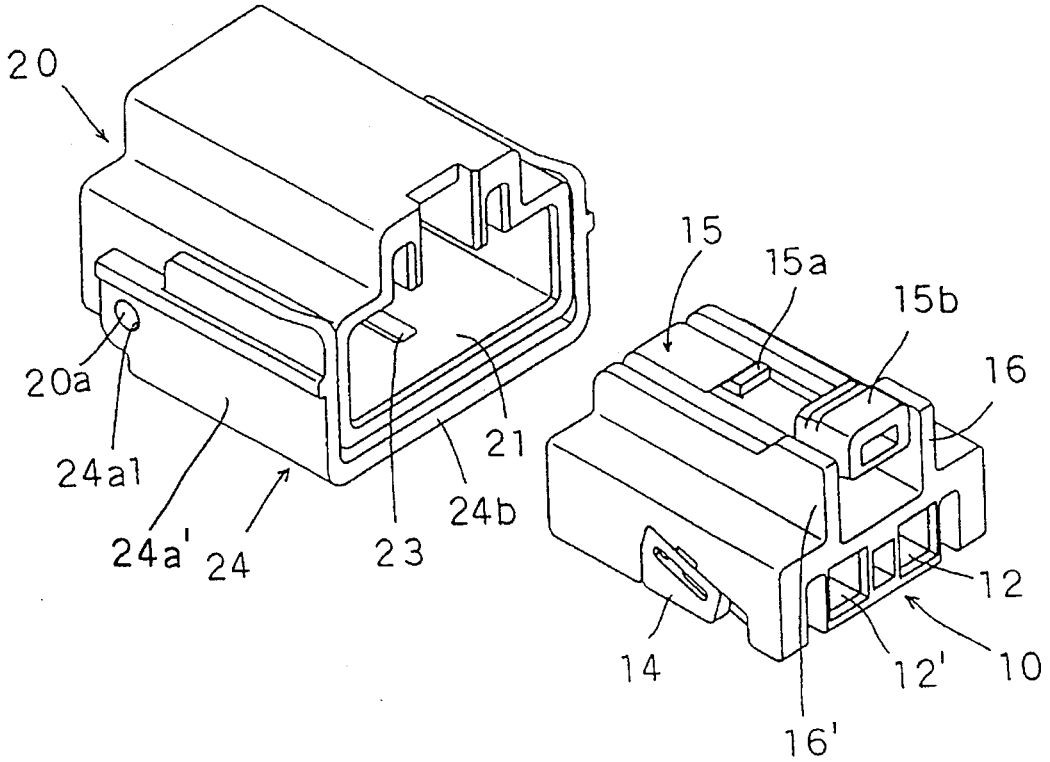
FIG. 3 is a perspective of the connector of FIG. 1, seen obliquely from below.

A plate-like projection 24*c* is on the lower surface of a flat base wall 24*b* connecting the side walls 24*a* and 24*a*', i.e. at the side of the flat base wall 24*b* facing the male connector housing 20. A slit-like communication hole 23 is formed in the upper wall of the housing 20 at a position corresponding to the projection 24*c*. As shown in FIG. 2, the projection 24*c* is projectable into the interior of the housing 20 through the communication hole 23. The plate-like projection 24*c* is oriented in a longitudinal direction, i.e. extends in the direction which the female connector housing 10 is to be inserted and projects substantially downward by a small distance at the front end close to the opening 21. The projected amount increases as it extends toward the rear end away from the opening 21 until it reaches bottom end 24*c*2; it then decreases until it eventually becomes continuous with the base wall 24*b*. In other words, the projection 24*c* has slanting surfaces which project downward, intersect, and thereby peak at the bottom end 24*c*2 of the projection 24*c*.

In this Specification, the slanting surface facing the opening 21 and the one opposite the opening 21 are referred to as an upward slanting surface 24*c*1 and a downward slanting surface 24*c*3, respectively. When the female connector housing 10 is inserted into the male connector housing 20, the contact member 18 first comes into contact with the upward slanting surface 24*c*1 thereby pushing up the projection 24*c* and rotating the movable member 24 in a direction away from the male connector housing 20. The movable member 24 is fulcrumed on the side walls 24*a*, 24*a*' of the male connector housing 20 by means of the pins 20*a*, 20*a*' and the through holes 24*a*1, 24*a*1'. The contact member 18 then further moves over the peak 24*c*2 of the projection 24*c*, and comes in contact with the downward slanting surface 24*c*3 when the housing 10 is pressed into a proper coupling position in the housing 20.

A middle portion of the rear end of the base wall 24*b* projects slightly backward, thereby forming a spring portion 24*d*. The far end of the spring portion 24*d* is located on the movable member 24 in a position behind (i.e. in a direction away from the opening) the holes 24*a*1 and 24*a*1' formed in the side walls 24*a* and 24*a*'. Thus, when the front end of the movable member 24 is pulled up with the holes 24*a*1 and 24*a*1' as a point of support or fulcrum, the spring portion 24*d* is pressed against the upper surface of the male connector housing 20, thereby being bent. In order to enhance elasticity of the spring, notches 24*d*1 and 24*d*1' are formed in the base wall 24*b* extending along part of the spring portion 24*d*.

In the bottom wall of the male connector housing 20, there are formed recesses corresponding to the lock arm 15 and guide walls 16 and 16'; a locking claw 25 interacts and is engageable with the locking projection 15*a*, after the lock arm 15 has flexed inwardly.

To understand the operation of the device, it should be appreciated that the female and male terminal fittings 11 and 22 connected to electric wires are mounted in advance in the female and male connector housings 10 and 20, respectively.

Figure 4:
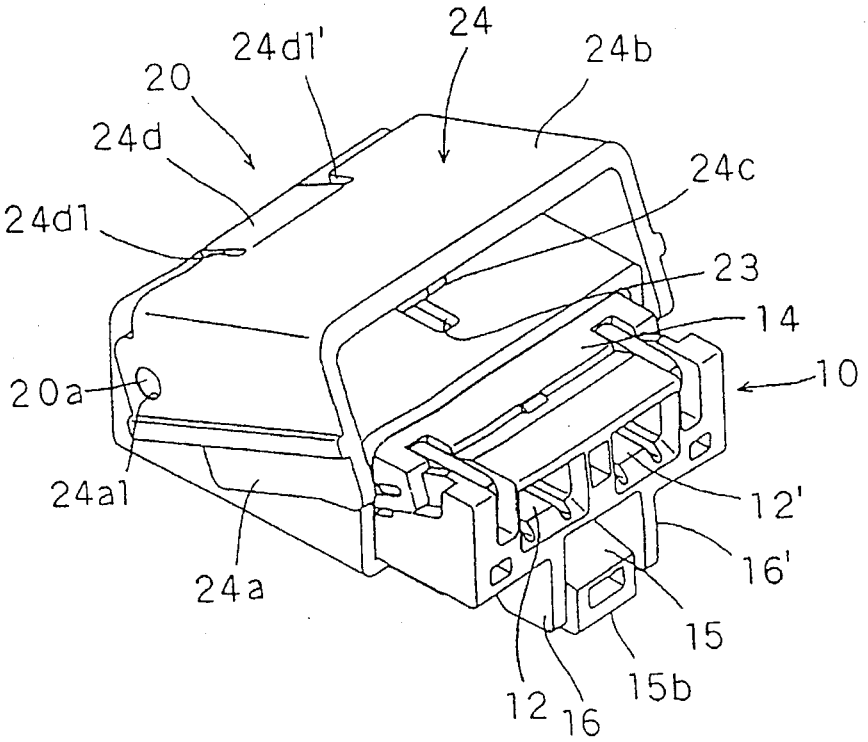
FIG. 4 is a perspective view, seen obliquely from above, showing the connector of FIG. 1 in a first stage of coupling.
Figure 5:
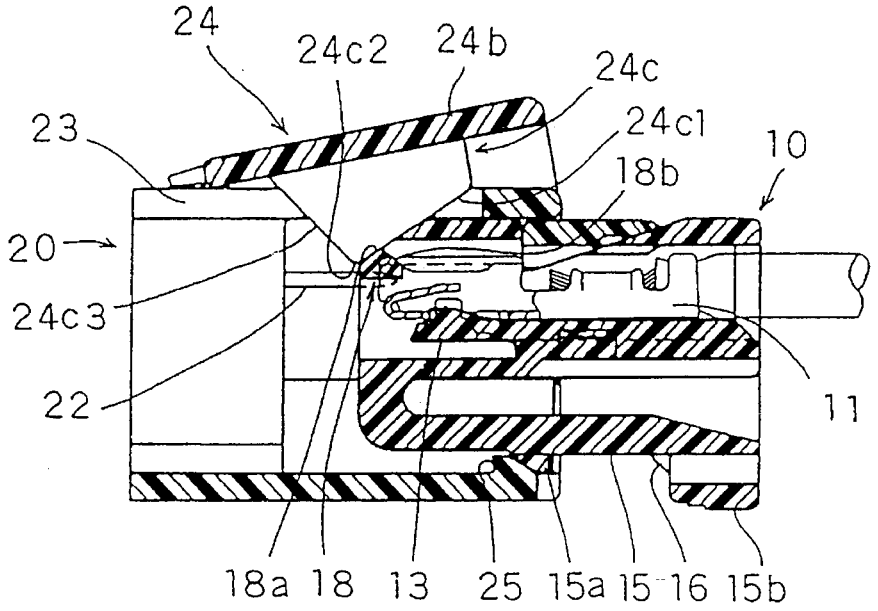
FIG. 5 is a section showing the connector coupling of FIG. 4.
Figure 6:
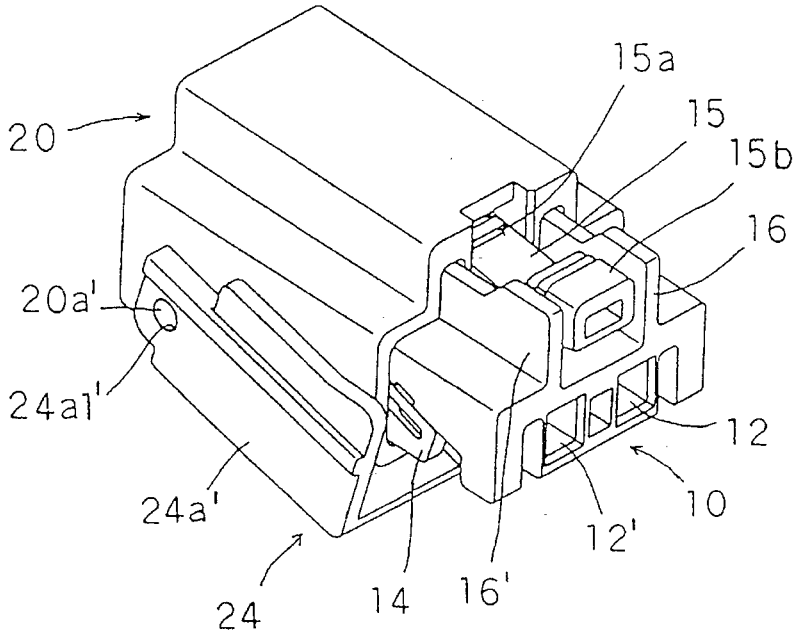
FIG. 6 is a perspective view, seen obliquely from below, of the connector coupling of FIG. 4.
Figure 7:
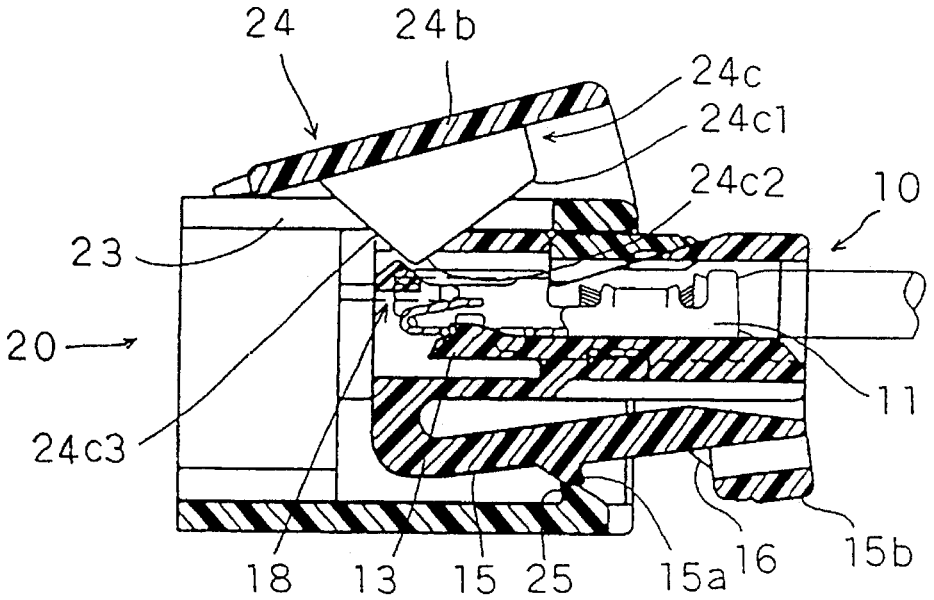
FIG. 7 is a section showing the connector of FIG. 4 in a second stage of coupling.

As shown in FIGS. 4 to 6, the female connector housing 10 is inserted into the male connector housing 20 through the opening 21. The lock arm 15 and guide walls 16 and 16' are guidably and slidably inserted along the corresponding recesses in the bottom wall of the male connector housing 20. At the upper wall of the male connector housing 20, the movable member 24 is initially in close contact with the upper surface of the male housing 20 and the projection 24*c* projects into the interior of the male connector housing 20 through the communication hole 23. Accordingly, as the female connector housing 10 is inserted, the contact member 18 between the terminal chambers 12, 12' comes into contact with the upward slanting surface 24*c*1 of the projection 24*c*.

When the female connector housing 10 is further inserted into the male connector housing 20, the front slanting surface 18*a* comes into sliding contact with the upward slanting surface 24*c*1 so that the projection 24*c* is pushed up by the contact member 18. Since the projection 24*c* projects from the movable member 24 and the movable member 24 is rotatably supported on the male connector housing 20 along its outer side surfaces, the front end of the movable member 24 is lifted with the pins 20*a*, 20*a*' as a fulcrum. Since the spring portion 24*d* projects at the rear end of the movable member 24 beyond the pins 20*a*, the leading end of the spring portion 24*d* is pressed against the upper surface of the male connector housing 20, thereby biasing the movable member 24 to rotate in the opposite direction. More specifically, since the projection 24*c* is pressed into contact with the contact member 18, the movable member 24 is not freely rotatable or movable relative to the upper surface of the male connector housing 20, even if the housing 20 is turned upside down, and it can be easily seen whether the electrical contact or connection has been securely made. Particularly, since the movable member 24 is formed into a hood in close contact with the male connector housing 20, even a slight contact of the projection 24*c* with the contact member 18 will leave movable member 24 in a position which is easily visible.

As the female connector housing 10 is further inserted, the peak of the contact member 18 moves over the peak 24*c*2 of the projection 24*c* immediately before the female terminal fittings 11 are coupled with their mating male terminal fittings 22. Then, the downward slanting surface 24*c*3 of the projection 24 is on or near the rear slanting surface 18*b* of the contact member 18. Thereafter, a large force is required to press the leading ends of the male terminal fittings 22 into the female terminal fittings 11. The movable member 24 is biased by the spring portion 24*d* toward the male connector housing 20, and this biasing force acts to press the peak 24*c*2 of the projection 24 downward, after the peak of the contact member 18 moves over the peak 24*c*2. In order to withdraw the female connector housing 10, the rear slanting surface 18*b* should lift the movable member 24 against the biasing force rendered from the spring portion 24*d* because of the projection 24*c* sliding in contact therewith. Thus, the female connector housing 10 cannot easily be withdrawn; in other words, it can easily be locked in the male connector housing 20.

Figure 8:
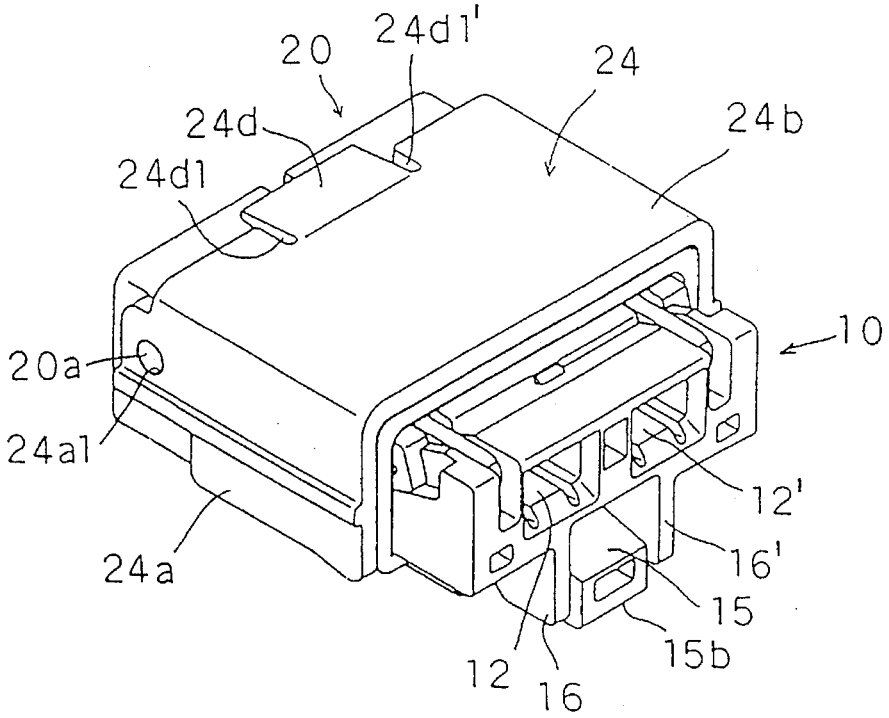
FIG. 8 is a perspective view of the connector of FIG. 1, fully coupled, seen obliquely from above.
Figure 9:
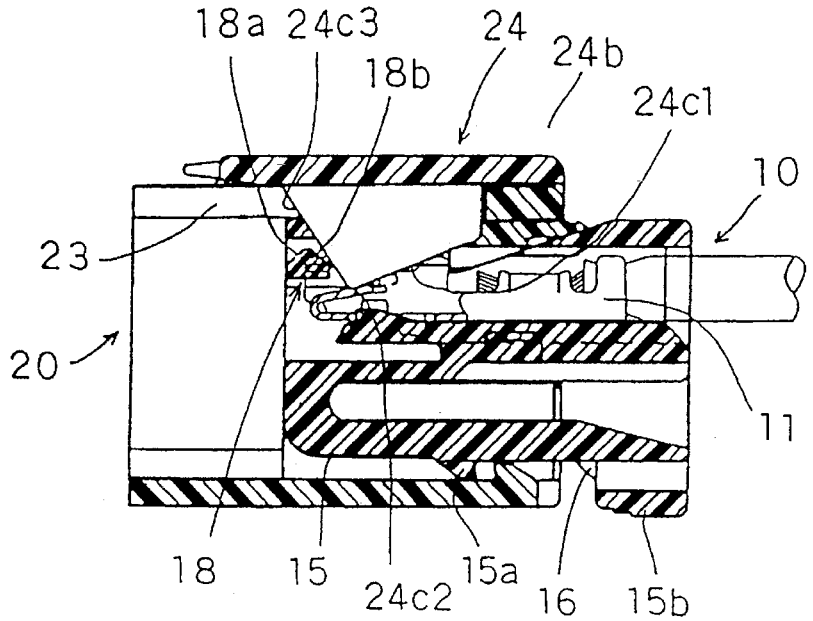
FIG. 9 is a section showing the connector of FIG. 8.
Figure 10:
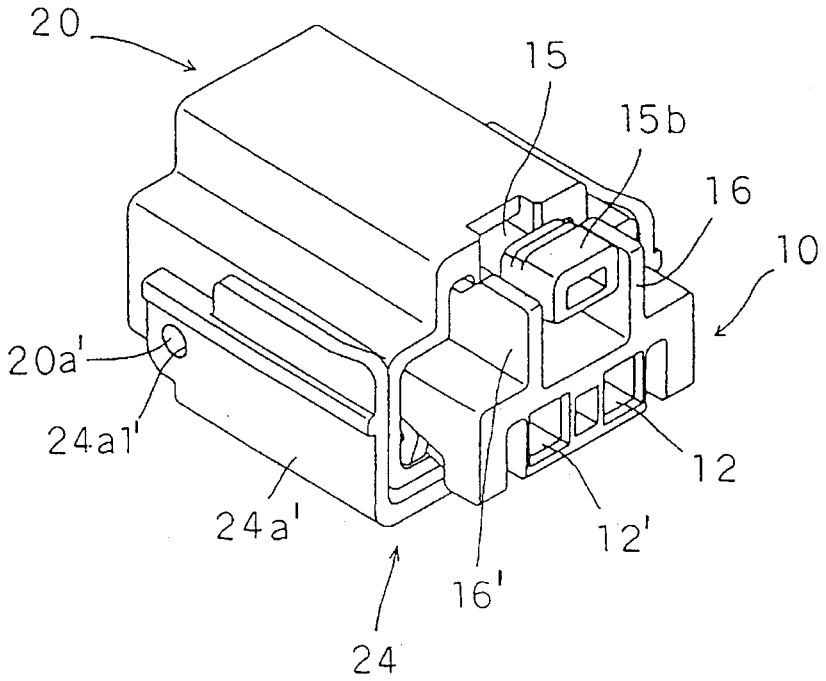
FIG. 10 is a perspective view of the connector of FIG. 8, seen obliquely from below.

When the front end of the movable member 24 is pressed toward the male connector housing 20, the downward slanting surface 24*c*3 slides down the rear slanting surface 18*b* so that the female connector housing 10 is further urged into the male connector housing 20. Holes 24*a*1, 24*a*1' act as the axis of rotation or fulcrum at the rear end of movable member 24 and the projection 24*c* is between the front and rear ends of the movable member 24. Thus, when the front end of the movable member 24 is pressed toward the housing 20, the load point is located between the fulcrum and the force point, thus the female connector housing 10 can be further inserted into the male connector housing 20 with a small force due to the leverage which the connector provides. When the movable member 24 is pressed into closer contact with the male connector housing 20, the female connector housing 10 is forced to the proper coupling position in the male connector housing 20 as shown in FIGS. 8 to 10. At this stage, the locking projection 15*a* of the lock arm 15 is engaged with the locking claw 25 of the male connector housing 20, thereby securely locking the female connector housing 10 in the male connector housing 20.

If the pressed movable member 24 is not in close contact with the male connector housing 20, it is readily visible; this indicates that the female connector housing 10 has not been inserted into the proper coupling position and that the electrical connection between the female and the male terminal fittings 11 and 22 may not be proper.

If the movable member 24 is pressed before the peak of the contact member 18 moves over the peak 24*c*2 of the projection 24*c* as shown in FIG. 5, the contact member 18 slides down along the upward slanting surface 24*c*1 of the projection 24*c*. As a result, the contact member 18 is forced out by pressure on the movable member 24 and/or due to the resilient force of the spring portion 24*d* of the movable member 24 toward the opening 21. Since the upward slanting surface 24*c*1 has a shallower gradient than downward slanting surface 24*c*3, the upward slanting surface 24*c*1 extends in a longitudinal direction over a longer distance than the downward slanting surface 24*c*3. Therefore, the distance which the female connector housing is pushed out is relatively long. Thus, it can easily be judged that the female connector housing 10 is pushed out, rather than locked in proper position, which eliminates the likelihood of overlooking the coupling failure.

As female connector housing 10 is inserted into male connector housing 20, contact member 18 moves over slanting surface 24*c*1, over bottom end 24*c*2, and onto slanting surface 24*c*3. As member 18 contacts upward slanting surface 24*c*1, it causes movable member 24 to pivot about pin 20*a* into its open position. After member 18 passes bottom end 24*c*2, it permits movable member 24 to close under the influence of spring portion 24*d*. It may be necessary for the operator to press movable member 24 against male housing 20 to reach the fully closed position. This will cause female housing 10 to seat firmly.

If, for any reason, female housing 10 is insufficiently inserted into male housing 20, closing movable member 24 will, due to the influence of upward slanting surface 24*c*1, cause female housing 10 to project substantially out of male housing 20. This is easily noted by the operator so that female housing 10 can be reinserted into male housing 20 to form a proper connection.

During insertion of the female connector housing 10 into the male connector housing 20, the locking projection 15*a* contacts and interacts, by means of a slanted surface thereof, with the holding claw 25. In particular, the slanted surface bears against a slanted portion of the holding claw 25, thereby causing the deflection of the lock arm 15 toward the main body of the female connector housing 10. After the female connector housing 10 has been inserted in the male connector housing 20 over a predetermined distance, the lock arm 15 engages the holding claw 25 in such a way as to block movement of the female connector housing 10 out of the male connector housing 20.

The female connector housing 10 can be withdrawn while pressing the operable portion 15*b* of the lock arm 15 toward the terminal chambers 12, 12' to bend the lock arm 15 so as to move the locking projection 15*a* out of engagement with the locking claw 25. During the withdrawal, the contact member 18 comes into contact with the movable member 24 and the female connector housing 10 can easily be withdrawn merely by lifting the movable member 24 slightly against the biasing force of the spring portion 24*d*. The movable member 24 is, at first, lifted or moved away from the male connector housing 20 by the contact member 18 coming into contact with the downward slanting surface 24*c*3 of the projection 24*c*, but moves toward the male connector housing 20 after the contact member 18 moves over the peak 24*c*2. The movable member 24 may be such that it is locked on the outer surface of the housing 20, but this leads to a more cumbersome operation because the movable member 24 must be unlocked in advance when the female connector housing 10 is withdrawn.

While only a limited number of specific embodiments of the present invention have been expressly described, the Invention may be embodied in several forms without departing from the spirit and the scope thereof.

For example, the movable member 24 can be of any shape, such as that of a lever, provided that it has slanting surfaces, preferably peaked. Although the movable member 24 is rotatable in the described embodiment, it may be slidable. In place of the spring portion 24*d*, an elastic member such as spring or rubber may be provided as a member for biasing the movable member 24 toward the male connector housing 20.

The upward and downward slanting surfaces 24*c*1 and 24*c*3 may be formed at the surfaces of separate members. In this case, the contact member may be in continuous sliding contact with both slanting surfaces at the side where the contact member is provided. Alternatively, the arrangement may be such that a guide pin slides along a peaked guide groove. Further, the movable member 24 may be formed with a contact member and the female connector housing may be formed with a projection having peaked slanting surfaces.

Although a single plate-like member is separately provided as a projection 24*c* in the foregoing embodiment, the peaked slanting surfaces may be formed on the inner surface of the male connector housing 20 or on the outer surface of the female connector housing 10 by making a recess or a projection.

What is claimed is:

1. A locking electrical connector comprising a first housing and a second housing, said first housing having at least one first terminal mounted therein, said second housing having at least one second terminal mounted therein, said first terminal mates with said second terminal when said first having engages with said second housing, a projection on a movable and a corresponding contact member on said second housing, said projection and said contact member interacts to urge said first housing and said second housing to move relative to each other, when said first housings moves into said second housing, said movable member mounted on said first housing and being pivoted to move between an open position, wherein a part of said movable member is spaced apart from said first housing, and a closed position, wherein said movable member is adjacent said first housing, a planar resilient portion, integably formed with said movable member and extending from a rear end of said movable member bearing against said first housing when said movable member is in said open position, whereby said planar resilient portion urges said movable member toward said first housing so that said movable member moves to said closed position.

2. The connector of claim 1 wherein said projection has slanting surfaces adapted to slidingly contact said contact member upon movement of said first housing and said second housing relative to each other.

3. The connector of claim 2 wherein said first housing and said second housing are moved away from each other upon said contact member contacts with one of said slanting surfaces, and said first housing and said second housings are moved toward each other upon said contact member contacts with another of said slanting surfaces.

4. The connector of claim 2 wherein said slanting surfaces meet to form a peak.

5. The connector of claim 1 wherein one of said first housing and said second housing is inserted into the other of said first housing and said second housing in an insertion direction, said contact member being beyond said projection in said insertion direction.

6. The connector of claim 1 wherein said movable member is pivotally mounted on said first housing and is rotatable about a pivot point toward and away from said first housing so that said projection contacts and interacts with said contact member.

7. The connector of claim 1 wherein said first housing has a locking claw and said second housing has a lock arm, said locking claw and said lock arm engaging each other upon coupling of said first housing and said second housing, thereby securing said first and second housings in a coupled position.

8. The connector of claim 7 wherein a locking projection is provided on said lock arm which is resiliently formed on said second housing, said locking projection engaging said locking claw when said first and second housings is in said coupled position.

* * * * *